US005329731A

United States Patent [19]

Wall

[11] Patent Number: 5,329,731

[45] Date of Patent: Jul. 19, 1994

[54] MULCHER BLADE GRINDER AND METHOD THEREOF

[75] Inventor: Gregory A. Wall, Nineveh, Ind.

[73] Assignee: Wall Enterprises, Inc., New Whiteland, Ind.

[21] Appl. No.: 88,669

[22] Filed: Jul. 7, 1993

[51] Int. Cl.[5] ..... B24B 3/36

[52] U.S. Cl. ..... 51/98 BS; 51/98 SP; 51/238 R; 51/102

[58] Field of Search ..... 51/217 R, 217 A, 216 A, 51/98 BS, 98 SP, 238 R, 92 ND, 91 BS, 92 BS, 102, 221 BS, 220

[56] References Cited

U.S. PATENT DOCUMENTS

| | | | |
|---|---|---|---|
| 2,767,531 | 10/1956 | Keller | 51/220 |
| 3,065,580 | 11/1962 | Benjamin et al. | 51/220 |
| 3,932,964 | 1/1976 | Simms | 51/221 BS |
| 4,736,544 | 4/1988 | Greenquist | 51/217 A |

*Primary Examiner*—Robert A. Rose
*Attorney, Agent, or Firm*—Woodard, Emhardt, Naughton, Moriarty & McNett

[57] ABSTRACT

A rotary grinder for sharpening mulcher blades. A grinding wheel is rotatably mounted atop a work support surface. A platform removably mounted to the work support surface includes a first upwardly facing blade supporting surface and a second upwardly facing blade support surface. The second blade supporting surface is obliquely arranged relative to the first blade supporting surface. The first blade supporting surface contacts the outer portion of the blade positioning the outer edge against the grinding wheel. The method includes moving the blade in a direction so that the outer edge of the blade moves past the grinding wheel with the blade moving off of the first upwardly facing blade supporting surface and onto the second upwardly facing blade supporting surface thereby positioning the obliquely arranged second cutting edge adjacent and against the grinding wheel. Further movement of the blade moves the second cutting edge past the grinding wheel until the blade is positioned again atop the first upwardly facing blade supporting surface thereby positioning a third cutting edge adjacent the grinding wheel.

8 Claims, 4 Drawing Sheets

MULCHER BLADE GRINDER AND METHOD THEREOF

BACKGROUND OF THE INVENTION

1. Field of the Invention

This is invention is in the field of devices for use in grinding blades.

2. Description of the Prior Art

It is the practice when sharpening a metal blade to move the blade past a rotary grinding wheel. For example, a lawn mower blade includes a pair of cutting edges located on the opposite sides and ends of the blade. A standard blade grinder includes a rotatably driven grinding wheel with a platform provided adjacent to the wheel to support the lawn mower blade as the blade is pushed past and against the grinding wheel.

Many blades include a plurality of cutting edges all of which are not located in the same plane. For example, a mulching blade used on a rotary lawn mower may include two or more cutting edges located at each end of the mulching blade. One such blade includes three cutting edges at each blade end with one cutting edge located between and obliquely arranged relative to the other two cutting edges. The bevel width or cutting angle of each cutting edge should be approximately the same. As a result, it is quite difficult to sharpen or grind each separate cutting edge. Typically, the work support surface and grinding wheel remain fixed necessitating the operator to hold the blade at a different angle relative to the grinding wheel for sharpening each edge. Disclosed herein is a platform for automatically positioning the particular cutting edge to be sharpened relative to the grinding wheel as the blade is moved against and past the wheel. The platform may be originally built into the grinding apparatus or may be added to an existing grinding apparatus.

SUMMARY OF THE INVENTION

One embodiment of the present invention is a blade grinding apparatus comprising a frame, a power source connected to the frame and having an rotary output, a grinding device mounted to the output to grind a first cutting edge and a second cutting edge on the blade, and a blade support on the frame. The blade support has a first blade supporting surface and a second blade supporting surface with the first blade supporting surface positioned at a first angle relative to the second blade supporting surface. The blade support is operable to first position blade when supported by the first blade supporting surface relative to the grinding device to grind the first cutting edge thereon and to then position the blade when supported by the second blade supporting surface relative to the grinding device to grind the second cutting edge thereon.

Another embodiment of the present invention is a platform for positioning a blade having cutting edges including a first cutting edge and a second cutting edge onto a blade grinding apparatus having a grinding wheel comprising a bracket having a first blade supporting surface and a second blade supporting surface with the first blade supporting surface positioned at a first angle relative to the second blade supporting surface. The bracket positions the blade when supported by the first blade supporting surface relative to the grinding wheel to grind the first cutting edg thereon and positions the blade when supported by the second blade supporting surface relative to the grinding wheel to grind the second cutting edge thereon. The bracket includes an upper platform and a downwardly slanting platform contiguous to the upper platform. The first blade supporting surface is located on the upper platform and faces outwardly and the second blade supporting surface is located on the downwardly slanting platform and faces outwardly.

It is an object of the present invention to provide means for automatically positioning a blade having multiple and different oriented cutting edges relative to a sharpening tool.

A further object of the present invention is to provide a platform for holding a blade relative to a sharpening tool.

Yet a further object of the present invention is to provide a new and improved blade grinding apparatus for sharpening differently oriented cutting edges on a blade.

Related objects and advantages of the present invention will be apparent in the following description.

DESCRIPTION OF THE PREFERRED EMBODIMENT

Figure 1:
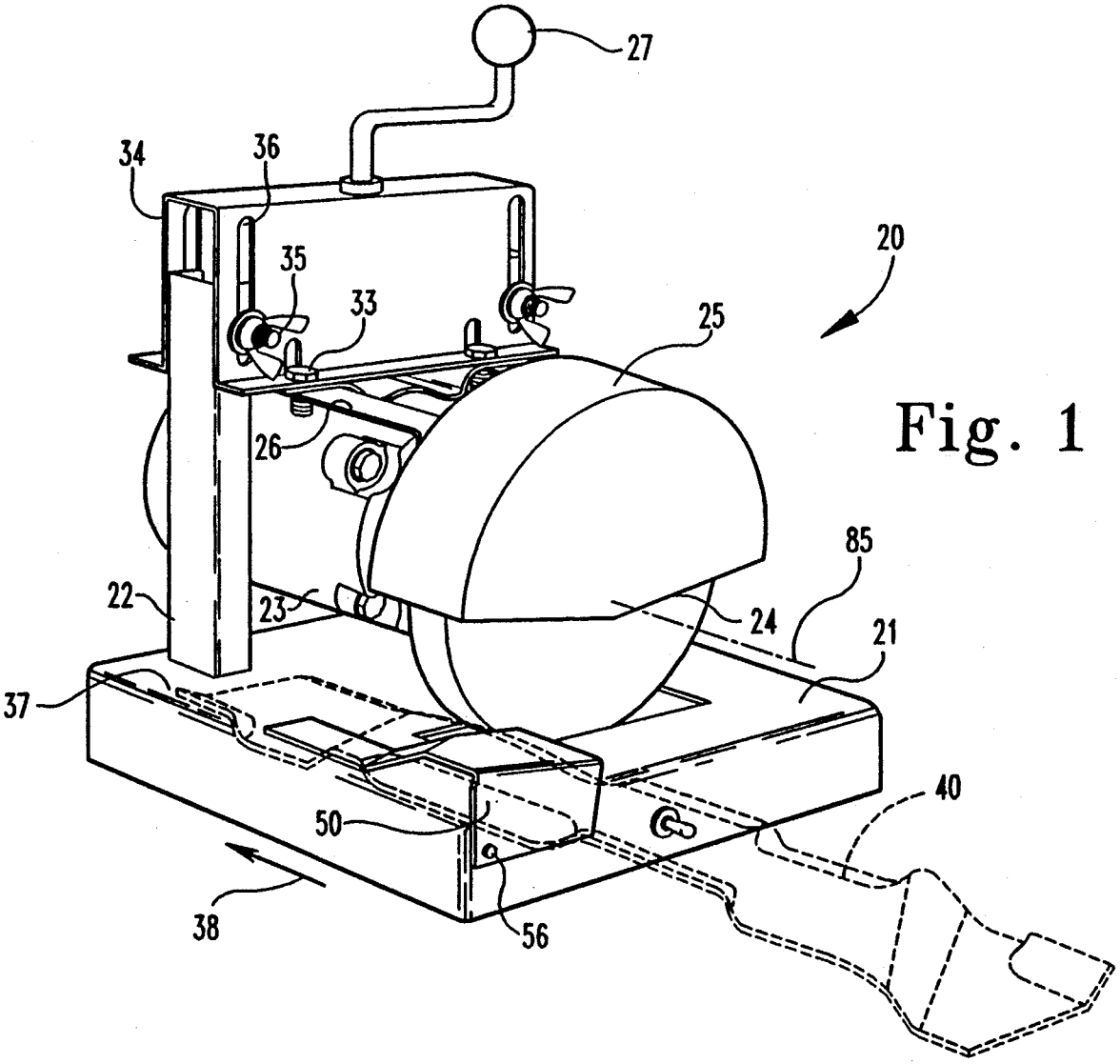
FIG. 1 is a perspective of my blade grinding device.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A blade grinding apparatus 20 is shown in FIG. 1 and has a main frame 21 of generally rectangular construction with a pair of posts 22 fixedly mounted thereatop. A conventional electric motor 23 includes flanges 26 mounted by fasteners 33 to a U-shaped downwardly opening bracket 34 mounted atop posts 22 by fasteners 35. A rotary grinding wheel 24 is mounted to the end of the rotary output of motor 23 and has a guard 25 extending partially therearound to limit movement of metal particles which are ground from the blade moved past and against wheel 24. A crank 27 is rotatably mounted to bracket 34 and is threadedly engaged with a member extending between posts 22 thereby allowing motor 23 and bracket 34 to be adjusted and moved vertically relative to the posts and frame 21. Bracket 34 includes four slots 36 through which fasteners 35 extend thereby limiting the vertical movement of bracket 34 and thus motor 23 relative to the upwardly facing work support surface 37 of frame 21. Such a device described is generally available from numerous commercial sources. The blade to be sharpened is positioned atop work support surface 37 of frame 21 and then moved in the direction of arrow 38 against grinding wheel 24 thereby sharpening the edge of the blade nearest the grinding wheel.

Figure 2:
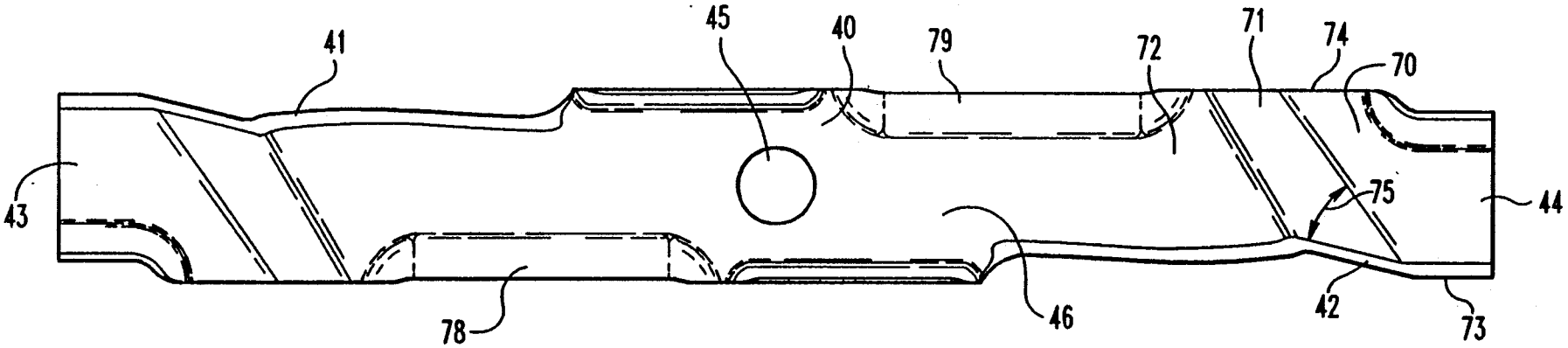
FIG. 2 is a plan view of a mulcher blade.
Figure 3:
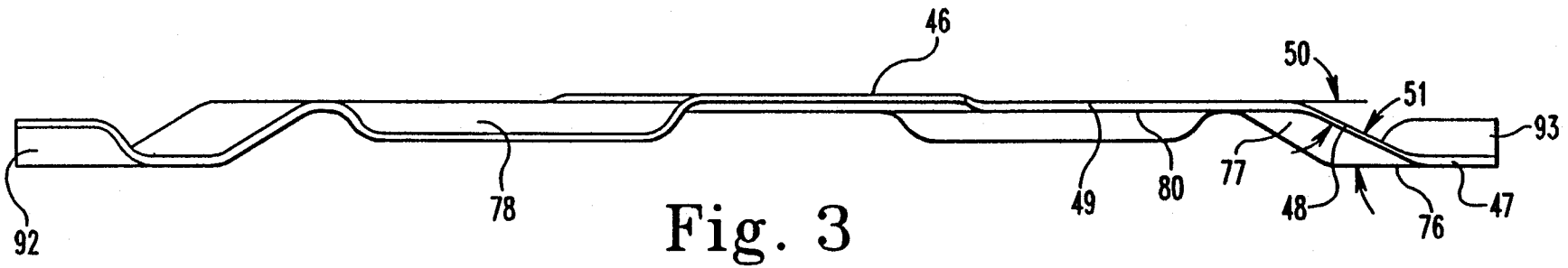
FIG. 3 is a side view of the blade of FIG. 2.

Many blades have multiple cutting edges located at different angles along the length of the blade. One such blade is a mulching blade used with a rotary lawn mower and is shown in FIGS. 2 and 3. Mulching blade 40 takes a variety of configurations and shape; however, the blade has a generally elongated rectangular shape with a pair of cutting edges 41 and 42 provided respectively along the lengths of the opposite end portions 43 and 44 of the blade. Assuming the blade is to rotate in a clockwise direction about its mounting hole 45 as shown in FIG. 2, cutting edge 42 is ground in the upwardly facing surface 46 along the lower right quadrant edge of end portion 44 whereas cutting edge 41 is provided in surface 46 along the upper left quadrant edge of end portion 43.

Figure 4:
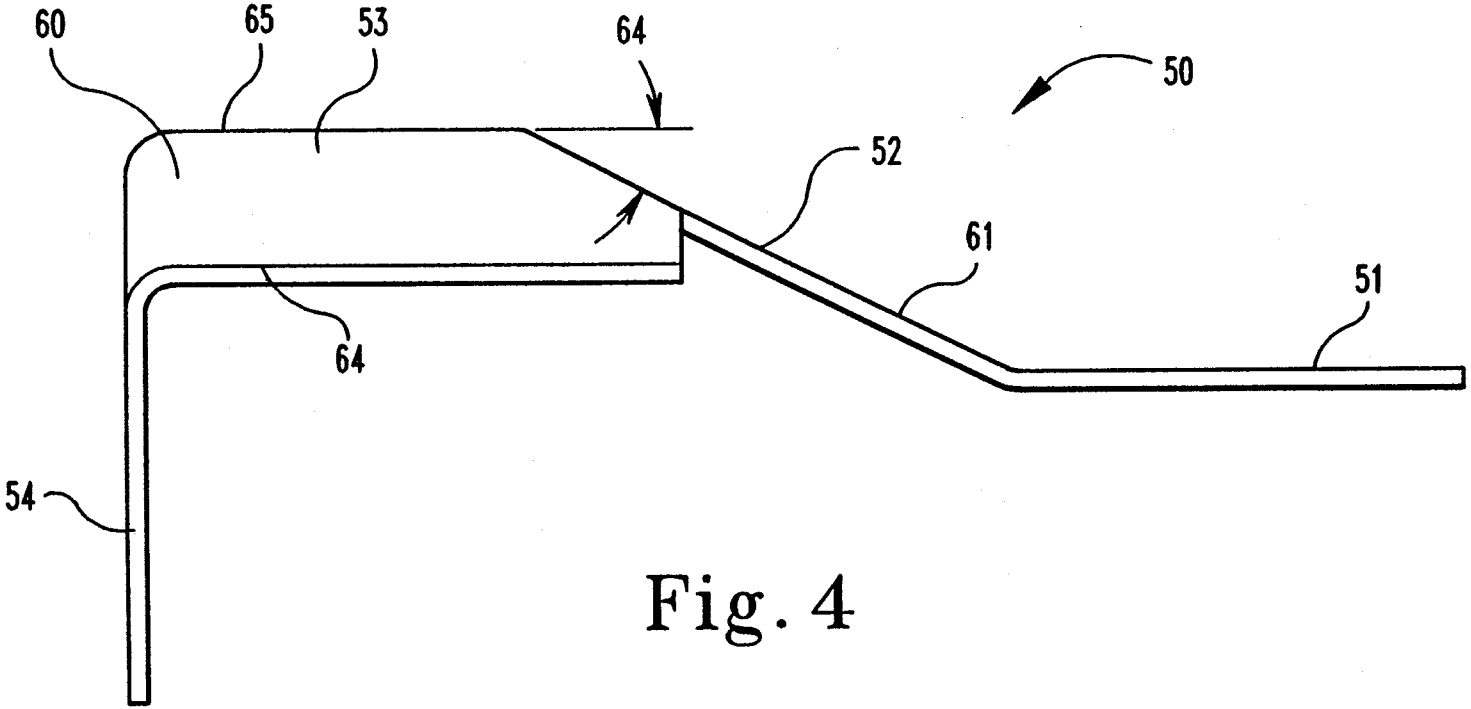
FIG. 4 is a side view of the mulcher blade platform.
Figure 5:
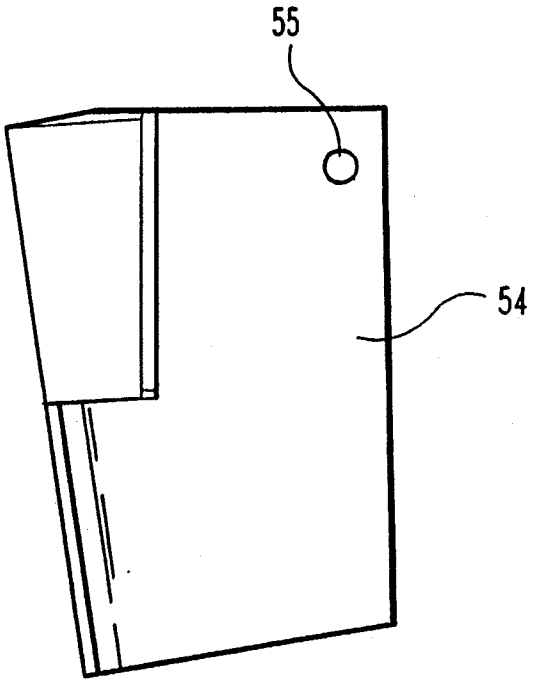
FIG. 5 is a reduced in size left end view of the platform of FIG. 4.
Figure 6:
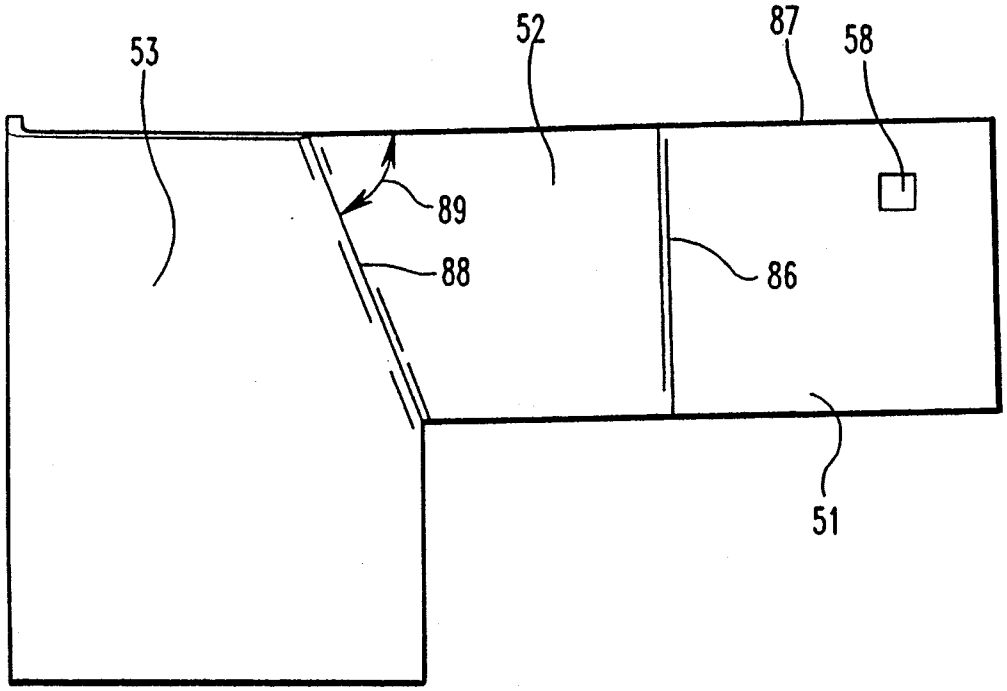
FIG. 6 is a plan view of the platform of FIG. 4.

Cutting edge 42 is identical in configuration and shape to the cutting edge 41 and thus the following description of edge 42 will apply equally to edge 41. Cutting edge 42 is composed of three separate but contiguous cutting edges and include namely an outer cutting edge 47, a middle or intermediate cutting edge 48, and an inner cutting edge 49. The main body of blade 40 is bent downwardly at its opposite extreme ends thereby positioning cutting edge 47 lower in elevation than cutting edge 49. Blade section 70 is lower in elevation than blade section 72 with blade section 71 extending obliquely therebetween. Section 70 is generally parallel to section 72 with cutting edges 47, 48 and 49 provided respectively on sections 70, 71, and 72. Notably, blade 40 includes the intermediate cutting edge 48 located obliquely with respect to cutting edges 47 and 49. In the blade shown in FIGS. 2 and 3, cutting edges 47 and 49 are located in parallel planes with cutting edge 48 positioned at angle 50 relative to cutting edge 49 and angle 51 relative to cutting edge 47. The trailing edge of blade 40 includes a pair of downwardly extending deflectors 78 and 79 located inwardly of the cutting edges. Likewise, a pair of upwardly extending deflectors 92 and 93 are located at the extreme ends respectively of end portions 43 and 44 on the trailing edge of the blade. In order to correctly position the differently oriented cutting edges 47–49 relative to grinding wheel 24, I have designed a platform or blade support illustrated in FIGS. 4–6 and shown mounted to the grinding apparatus depicted in FIG. 1. Blade 40 is commercially available from a variety of sources.

Blade support 50 is removably mounted to frame 21 and includes an inner portion 51 integrally joined by an intermediate portion 52 to an outer portion 53. The blade support or bracket has a downwardly extending wall 54 integrally connected to the outer portion 53 with a circular hole 55 (FIG. 5) extending therethrough. The vertical wall 54 is sized to receive a horizontally extending pin 56 fixedly mounted to frame 21. The opposite or inner portion 51 of the blade support includes a square hole 58 extending therethrough. A carriage bolt, not shown, has a round head positioned atop portion 51 with the bolt having a square under carriage extending through hole 58 and through the upwardly facing work surface 37 of frame 21 being threadedly received by a fastener such as a wing nut to secure the blade support atop frame 21. Thus, in order to remove the blade support from frame 21, the bolt extending through hole 58 is unfastened and the blade support is then moved to the right as viewed in FIG. 1 until pin 56 disengages hole 55.

Inner portion 51 is perpendicularly arranged to vertical wall 54. Thus, when wall 54 is extended vertically against the vertical end surface of frame 21, inner portion 51 of the blade support extends horizontally atop work surface 37. The upwardly facing surfaces of intermediate portion 52 and outer portion 53 are therefore automatically positioned relative to grinding wheel 24.

The upwardly facing surface 60 of outer portion 53 provides a first blade supporting surface whereas the upwardly facing surface 61 of intermediate portion 52 provides a second blade supporting surface. The upwardly facing surface 61 of intermediate portion 52 extends downwardly at angle 64 relative to the upwardly facing surface 60 at the rear edge 65 as viewed in FIG. 4, of outer portion 53. Likewise, outer portion 53 slopes downwardly toward the grinding wheel in a direction from the rear edge 65 to the front edge 64 of the outer portion. Blade supporting surface 60 extends adjacent to and in line with blade supporting surface 61. That is, the two supporting surfaces are contiguous but are located at different elevations. Blade supporting surface 61 extends downwardly to inner portion 51 located immediately atop frame 21.

Both blade supporting surfaces 60 and 61 provide a platform upon which blade 40 may be rested as it is pushed past and against grinding wheel 24. In order to sharpen or grind cutting edges 47–49, end portion 44 of blade 40 is positioned atop the first blade supporting surface 60 with blade 40 then being moved in a direction of arrow 38 past and against the outwardly facing radial surface of grinding wheel 24. Section 70 has a minimum width at the leading edge 73 of the blade and a maximum width along the trailing edge 74 of the blade resulting in section 71 extending rearwardly at angle 75 relative to the leading edge.

The downwardly facing surface 76 (FIG. 3) of section 70 is positioned atop the upwardly facing surface 60 (FIG. 4) with blade 40 then being moved in the direction of arrow 38 causing edge 47 to contact grinding wheel 24. Eventually, the downwardly facing surface 76 will move off the upwardly facing surface 60 allowing the downwardly facing surface 77 of section 71 to contact and be supported by the upwardly facing surface 61 of intermediate portion 52 of the blade support. Thus, cutting edge 48 is automatically positioned adjacent and at the correct elevation relative to the grinding wheel as the blade is moved in the direction of arrow 38 against and past the grinding wheel. In order to maintain the approximate same degree of bevel on cutting edges 47–49, it is important that blade 40 contact grinding wheel 24 at the same approximate elevation. Thus, by providing the downwardly intermediate portion 52, section 70 is allowed to be positioned lower in elevation while section 71 occupies the elevation relative to the grinding wheel previously occupied by section 70 as the blade is moved past the grinding wheel. In similar fashion, eventually surface 77 will move off of surface 61 resulting in the downwardly facing surface 80 of section 72 contacting and being supported by the upwardly facing surface 60 of the blade support. Continued movement of blade 40 in the direction of arrow 38 against and past the grinding wheel will result in cutting edge 49 being ground or sharpened with section 72 occupying the space previously occupied by section 71 as the blade is moved past the grinding wheel. The blade support is therefore operable to first position blade 40 when supported by surface 60 relative to the grinding wheel 24 to grind the first cutting edge 47 thereon and to then position the blade when supported by the second blade supporting surface 61 relative to the grinding wheel to grind the second cutting edge 48 thereon. Further, the blade support is operable to position the blade when surface 80 is supported atop surface 60 relative to the grinding wheel to grind a third cutting edge 49 on the blade. The vertical distance between blade surfaces 76 and 80 is less than the vertical distance between surface 60 and the top surface of inner portion 51 to insure surface 80 contacts surface 60 when cutting edge 49 is sharpened while section 70 is spaced above inner portion 51.

The upwardly facing work support surface 37 of frame 21 extends through a plane perpendicularly arranged relative to wheel 24 and parallel to the axis of rotation 85 of wheel 24. Surface 61 extends in an oblique direction relative to the direction of axis 85 and the plane containing surface 37 of frame 21. Since section 71 extends at angle 75 (FIG. 3) rearwardly from the leading edge 73 of the blade, it is necessary to extend blade support portion 52 (FIG. 6) in like manner. Thus, portion 52 is joined to portion 51 along a line 86 perpendicularly arranged relative to the outer edge 87 of the blade support; however the opposite end of innermediate portion 52 is joined to outer portion 53 along line 88 arranged at angle 89 relative to edge 87.

The method of grinding a cutting edge on a blade comprises the steps of moving or rotating grinding wheel 24 having an outwardly facing circumferentially extending grinding surface and then holding blade 40 on the platform formed by the upwardly facing surface 60 (FIG. 4) to position the outer end or section 70 (FIG. 2) of the blade against the wheel grinding surface as the grinding surface moves forming the first cutting edge 47. Section 70 is then moved past the grinding wheel positioning the adjacent section 71 of the blade adjacent the grinding surface while holding the blade on the second platform formed by the upwardly facing surface 61 (FIG. 4) positioning section 71 of the blade against the grinding wheel forming the second cutting edge 48. Further, the blade is moved so that the adjacent or inner section 72 (FIG. 2) of the blade is moved past the wheel grinding surface positioning section 72 next to the wheel grinding surface while holding the blade on the blade platform so that surface 80 (FIG. 3) of the blade is positioned atop the upwardly facing surface 60 (FIG. 4) forming the third cutting edge 49. The method further includes the step of mounting the bracket or blade platform 40 on the grinding device 20. Notably, the second platform formed by the upwardly facing surface 61 is arranged at an unchangeable fixed first angle 64 relative to the first platform 53. That is, by using the platform disclosed in the drawings, it is unnecessary to provide an adjustable or manually variable platform to properly hold or position the blade relative to the grinding wheel.

In one embodiment of the blade support 50, angle 89 is approximately 70 degrees whereas angle 64 is approximately 20 degrees. In the same embodiment, surface 60 extended downwardly relative to the horizontal at an approximate angle of 10 degrees.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A blade grinding apparatus comprising:

a frame;

power means connected to said frame and having an rotary output;

grinding means mounted to said output to grind a first cutting edge and a second cutting edge on a blade;

blade supporting means on said frame, said blade supporting means having a first blade supporting surface and a second blade supporting surface with said first blade supporting surface positioned at a first angle relative to said second blade supporting surface, said blade supporting means operable to first position said blade when supported by said first blade supporting surface relative to said grinding means to grind said first cutting edge thereon and to then position said blade when supported by said second blade supporting surface relative to said grinding means to grind said second cutting edge thereon; and wherein:

said first blade supporting surface extends adjacent and in line with but at a different elevation than said second blade supporting surface;

said grinding means includes a grinding wheel rotatably mounted to said frame having an axis of rotation to grind a third cutting edge on said blade with said second cutting edge located between said first cutting edge and said third cutting edge;

said blade supporting means includes a bracket with an outer portion and an inner portion mounted to said frame, said bracket further includes an upper platform extending in the same direction as said axis and a downwardly slanting platform contiguous to said upper platform, said first blade supporting surface located on said upper platform and facing outwardly, said second blade supporting surface located on said downwardly slanting platform and facing outwardly;

said inner portion spaced apart from said outer portion in elevation so said blade supporting means is operable to position said blade when supported by said first blade supporting surface relative to said grinding wheel to grind a third cutting edge on said blade.

2. The blade grinding apparatus of claim 1 wherein:

said outer portion has a first wall integrally joined to said upper platform with said first wall extending downwardly adjacent to said frame and having first means removably connected to said frame, said inner portion includes a second wall having second means removably connected to said frame.

3. The blade grinding apparatus of claim 2 wherein:

said frame includes an upwardly facing work support surface perpendicularly positioned relative to said grinding wheel, said second blade supporting surface is oblique relative to said first blade supporting surface which slants downwardly as it extends toward said grinding wheel.

4. A blade grinding apparatus comprising:

a frame;

a motor connected to said frame and having an rotary output;

a grinding wheel mounted to said output to grind a first cutting edge and a second cutting edge on a blade;

a blade support on said frame, said blade support having a first blade supporting surface and a second blade supporting surface with said first blade supporting surface positioned at a first angle relative to said second blade supporting surface, said blade support positions said blade when supported by said first blade supporting surface relative to said grinding wheel to grind said first cutting edge thereon and positions said blade when supported by said second blade supporting surface relative to said grinding wheel to grind said second cutting edge thereon; and wherein:

said grinding wheel is rotatably mounted to said frame having an axis of rotation;

said blade support includes a bracket with an outer portion and an inner portion removably mounted to said frame, said bracket further includes an upper platform extending in the same direction as said axis and a downwardly slanting platform contiguous to said upper platform, said first blade supporting surface located on said upper platform and facing outwardly, said second blade supporting surface located on said downwardly slanting platform and facing outwardly.

5. The blade grinding apparatus of claim 4 wherein:

said outer portion has a first wall integrally joined to said upper platform with said first wall extending downwardly adjacent to said frame and having first means removably connected to said frame, said inner portion includes a second wall having second means removably connected to said frame.

6. The blade grinding apparatus of claim 4 wherein:

said frame includes an upwardly facing work support surface perpendicularly positioned relative to said grinding wheel, said second blade supporting surface is oblique relative to said first blade supporting surface which slants downwardly as it extends toward said grinding wheel.

7. A platform for positioning a blade having cutting edges including a first cutting edge and a second cutting edge on a blade grinding apparatus having a grinding wheel comprising:

a bracket having a first blade supporting surface and a second blade supporting surface with said first blade supporting surface positioned at a first angle relative to said second blade supporting surface, said bracket positions said blade when supported by said first blade supporting surface relative to said grinding wheel to grind said first cutting edge thereon and positions said blade when supported by said second blade supporting surface relative to said grinding wheel to grind said second cutting edge thereon, said bracket including an upper platform and a downwardly slanting platform contiguous to said upper platform, said first blade supporting surface being located on said upper platform and facing outwardly and said second blade supporting surface located on said downwardly slanting platform and facing outwardly; and wherein:

said upper platform has a first wall extending therefrom with mounting means provided thereon, said bracket including an inner portion with a second wall having mounting means provided thereon with said second platform located between said upper platform and said inner portion.

8. A blade grinding apparatus comprising:

a frame;

a motor having an rotary output;

a grinding wheel mounted to said output and having an axis of rotation to grind a first cutting edge and a second cutting edge on a blade;

a blade support on said frame, said blade support having a first blade supporting surface and a second blade supporting surface with said first blade supporting surface positioned at a first angle relative to said second blade supporting surface, said blade support positions said blade when supported by said first blade supporting surface relative to said grinding wheel to grind said first cutting edge thereon and positions said blade when supported by said second blade supporting surface relative to said grinding wheel to grind said second cutting edge thereon, said blade support including a bracket with an outer portion and an inner portion mounted to said frame, said bracket further including an upper platform extending in the same direction as said axis and a downwardly slanting platform contiguous to said upper platform, said first blade supporting surface located on said upper platform and facing outwardly, said second blade supporting surface located on said downwardly slanting platform and facing outwardly.

* * * * *